US007742716B2

(12) United States Patent
Iida et al.

(10) Patent No.: US 7,742,716 B2
(45) Date of Patent: Jun. 22, 2010

(54) IMAGE FORMING SYSTEM

(75) Inventors: Junichi Iida, Kanagawa pref (JP); Junichi Tokita, Kanagawa pref (JP); Shingo Matsushita, Kanagawa pref (JP); Kenji Yamada, Kanagawa pref (JP); Hiroshi Kubo, Kanagawa pref (JP); Naohiro Kikkawa, Kanagawa pref (JP)

(73) Assignee: Ricoh Company, Ltd., Tokyo (JP)

( * ) Notice: Subject to any disclaimer, the term of this patent is extended or adjusted under 35 U.S.C. 154(b) by 535 days.

(21) Appl. No.: 11/730,773

(22) Filed: Apr. 4, 2007

(65) Prior Publication Data

US 2007/0231037 A1 Oct. 4, 2007

(30) Foreign Application Priority Data

Apr. 4, 2006 (JP) ..... 2006-102733
Jan. 31, 2007 (JP) ..... 2007-020262
Feb. 13, 2007 (JP) ..... 2007-031522

(51) Int. Cl.
*G03G 15/00* (2006.01)

(52) U.S. Cl. ..... 399/82; 399/43; 399/410

(58) Field of Classification Search ..... 399/14, 399/18, 20, 31, 43, 45, 81, 82, 405, 407, 399/408, 410
See application file for complete search history.

(56) References Cited

U.S. PATENT DOCUMENTS 5,464,201 A * 11/1995 Deen et al. ..... 270/58.09
6,381,443 B1 * 4/2002 Kawata et al. ..... 399/407
6,714,316 B1 * 3/2004 Nishiyama ..... 358/1.18
2002/0135119 A1 9/2002 Suzuki et al.
2003/0057641 A1 3/2003 Yamada et al.
2003/0234487 A1 12/2003 Tamura et al.
2005/0067777 A1 3/2005 Iida et al.
2005/0218579 A1 10/2005 Yamada et al.
2005/0225021 A1 10/2005 Yamada et al.
2006/0067724 A1 * 3/2006 Sato ..... 399/82
2007/0029716 A1 2/2007 Yamada et al.

FOREIGN PATENT DOCUMENTS

JP 01-193757 8/1989
JP 02-137860 5/1990
JP 03-153393 7/1991
JP 04-059564 2/1992
JP 11-189365 7/1999
JP 2003-057999 2/2003
JP 2005-017692 1/2005

* cited by examiner

*Primary Examiner*—David P Porta
*Assistant Examiner*—Benjamin Schmitt
(74) *Attorney, Agent, or Firm*—Harness, Dickey & Pierce, P.L.C.

(57) ABSTRACT

An image forming system includes: an image forming mechanism configured to form an image on a sheet of a transfer material; a post-processor configured to perform post-processing on a plurality of sheets of transfer materials, respectively, there being on at least one of which a respective image has been formed by the image forming mechanism; a transporter to transport the sheets through the post-processor along one or more transport paths; and a controller operable to do the following including, determine a first stopping condition of whether the number of sheets exceeds a reference number, and detect a second stopping condition of whether a cumulative thickness of the sheets loaded in the post-processor exceeds a reference thickness, and stop further image formation by the image forming mechanism when at least one of the first and second stopping conditions is satisfied.

19 Claims, 18 Drawing Sheets

| FIG. 7A |
| --- |
| FIG. 7B |

| FIG. 12A |
| --- |
| FIG. 12B |

| FIG. 13A |
| --- |
| FIG. 13B |

| FIG. 18A |
| --- |
| FIG. 18B |

IMAGE FORMING SYSTEM

PRIORITY STATEMENT

This patent application is based on and claims priority under 35 U.S.C. §119 upon the following Japanese patent applications, No. JP 2006-102733 filed on Apr. 4, 2006, No. JP2007-020262 filed on Jan. 31, 2007, and No. JP2007-031522 filed on Feb. 13, 2007, in the Japanese Patent Office, the entire contents of each of which are incorporated herein by reference.

FIELD

Example embodiments of the present invention generally relate to an image forming system, for example, to such an image forming system including a post-processor to perform post-processing of transfer materials.

DISCUSSION OF THE BACKGROUND

In general, an electronographic image forming system, for example, a copier, a facsimile, a printer, etc., includes an image forming mechanism, an ejection tray, and a finisher. The image forming mechanism may form an image, such as a toner image, on a sheet of a recording medium (e.g. transfer material). After images are formed, the sheets may be sent to the finisher that may perform post-processing, for example, aligning, sorting, stapling, and/or punching of recording mediums.

However, it is inappropriate to staple the sheets when the finisher receives a larger amount of sheets than it has the capacity to staple or when only one recording medium is sent to the finisher. In such cases, the finisher may eject the sheets without stapling.

An example finisher may include a stapler to staple sheets, a stapling determination unit to determine whether or not stapling is appropriate, and an ejection tray. The stapling determination unit may include a unit to determine whether or not the number of transfer materials exceeds the capacity of the stapler. When the finisher determines that the stapling of the transfer materials is inappropriate, the finisher may eject the sheets onto the ejection tray without stapling.

However, use of glossy sheets in an image forming system has been increasing due to an increased demand for photo image forming. The glossy sheets have lower friction force and are more slippery. Therefore, it is difficult to tidily stack a large amount of glossy sheets on the ejection tray when the sheets are automatically ejected without being stapled. Further, failure in transporting the sheets (e.g. paper jam) may occur.

SUMMARY

An embodiment of the preset invention provides an image forming system that includes: an image forming mechanism configured to form an image on a sheet of a transfer material; a post-processor configured to perform post-processing on a plurality of sheets of transfer materials, respectively, there being on at least one of which a respective image has been formed by the image forming mechanism; a transporter to transport the sheets through the post-processor along one or more transport paths; and a controller operable to do the following including, determine a first stopping condition of whether the number of sheets exceeds a reference number, and detect a second stopping condition of whether a cumulative thickness of the sheets loaded in the post-processor exceeds a reference thickness, and stop further image formation by the image forming mechanism when at least one of the first and second stopping conditions is satisfied.

Additional features and advantages of the present invention will be more fully apparent from the following detailed description of example embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
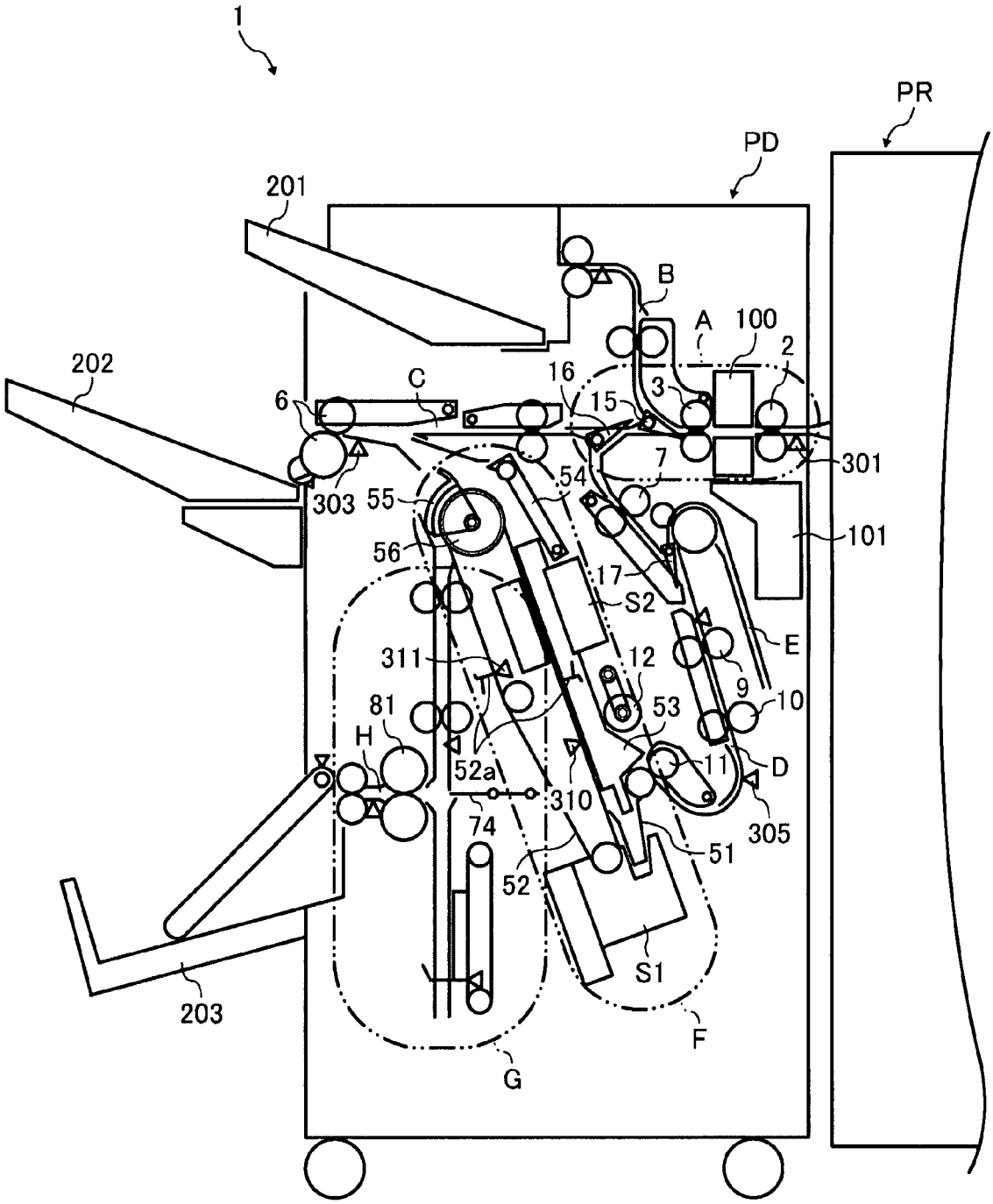
FIG. 1 is a schematic cross view of an image forming system according to an example embodiment of the present invention.

It will be understood that if an element or layer is referred to as being "on," "against," "connected to" or "coupled to" another element or layer, then it can be directly on, against connected or coupled to the other element or layer, or intervening elements or layers may be present. In contrast, if an element is referred to as being "directly on", "directly connected to" or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner. Referring now to the drawings, wherein like reference numerals designate identical or corresponding parts throughout the several views, particularly to FIG. 1, an image forming system 1 according to an example embodiment is described.

FIG. 1 illustrates the image forming system 1 including an image forming apparatus PR and a finisher (or post-processor) PD. The finisher PD may be attached to a side of the image forming apparatus PR. The finisher PD may include a transport path A that may connect to a transport path B leading to an upper tray 201, a transport path C leading to a shift tray 202 (an example of an output tray), and a transport path D leading to a stapling tray F. The finisher PD may further include an entrance roller 2, transport roller 3, separation claws 15 and 16, a puncher 100, a hopper 101, and an entrance sensor 301 along the transport path A, and an ejection roller 6 along the transport path C.

The entrance sensor 301 is a counter and may sense and count a sheet (transfer material) that comes from the image forming apparatus PR. The entrance roller 2 and transport roller 3 transport the sheet along the transport path A. The separation claws 15 and 16 may switch sheet transport directions to the transport path B, C, or D. The puncher 100 may punch the sheet. The hopper 101 may receive scraps of sheet cut off by the puncher 100.

The finisher PD may further include transport rollers 7, 9, and 10, an ejection roller 11, a separation claw 17, and a sheet stacker E, along the transport path D. The transport rollers 7, 9, and 10 transport the sheet along the transport path D. The ejection roller 11 forwards the sheet into the stapling tray F where the sheet is aligned and/or stapled. The separation claw 17 may switch the sheet transport direction to the sheet stacker E, or to the stapling tray F. When the transport roller 9 is reversed after a trailing edge of the sheet passes the separation claw 17, the sheet is stacked in the sheet stacker E. In this time, at least one of the transport roller 10 and the ejection roller 11 may be also rotated. By repeating this action, two or more of sheets may be transported into a pile. The entrance roller 2, the transport rollers 3, 7, 9, and 10, and the ejection roller 11 are transporters.

The finisher PD may further include a separation guide 54, a movable guide 55, a folding tray G on which the sheet may be folded, a folding plate 74, a pair of folding rollers 81, a transport path H, and a lower tray 203.

After the sheets are aligned and/or stapled in the stapling tray F, the separation guide 54 and the movable guide 55, which are direction turning members, may switch the sheet transport direction to the transport path C or to the folding tray G. The sheet folded on the folding tray G may be sent to the lower tray 203 through the transport path H.

Functions of the separation claws 15 and 16 are further described. The finisher PD may further include solenoids for the separation claws 15 and 16. When the solenoids are turned on, the separation claw 15 and 16 may rotate. To lead the sheet to the transport path B, the solenoid for the separation claw 15 is off to get the separation claw 15 in a state illustrated in FIG. 1. To lead the sheet to the transport path C, the both solenoids are turned on to rotate the separation claw 15 upward and the separation claw 16 downward. To lead the sheet to the transport path D, the solenoid for the separation claw 15 is turned on and the solenoid for the separation claw 16 is turned off. When the sheet is not aligned and/or stapled in the stapling tray F, the sheet may be transported along the transport path B and ejected onto the upper tray 201.

The finisher PD may further include a shift sheet sensor 303 and a stapler sheet sensor 305. The shift sheet sensor 303 may be turned on, sensing a sheet transported to the shift tray 202. The stapler sheet sensor 305 may be turned on, sensing the sheet transported to the stapling tray F.

Next, the stapling tray F is described. The finisher PD may further include an aligning roller 12, a back-end fence 51, a release belt 52, a pair of jogger fence 53, a plurality of release rollers 56, a side stapler S1, a pair of saddle stitchers S2, a stapling tray sheet detector 310, and a release belt home position (HP) sensor 311. A pair of release claws 52*a* may be provided on a circumference of the release belt 52. The positions of the release claws 52*a* may be opposite to each other with respect to the release roller 56.

The aligning roller 12 may align the sheets sent to the stapling tray F one by one in a longitudinal direction that is parallel to the sheet transport direction. The jogger fences 53 may push the sheets from both sides to align the sheets in a transverse direction, which is perpendicular to the sheet transport direction. After the alignment, the sheets may be stitched into a bundle and ejected on the shift tray 202, or folded and ejected on the lower tray 203.

The side stapler S1 staples a plurality of sheets into a bundle thereof in the stapling tray F along its side in a break between jobs, which is a period before a sheet of next set is loaded after all sheets in a set are loaded in the stapling tray F.

The release belt 52 forwards the bundle of sheets to the ejection roller 6 immediately after stapling. At this time, the shift tray 202 may be at an upper position to receive the sheets (receiving position). The shift tray 202 may descend depending on the number of sheets loaded therein and may move in a horizontal direction, which is perpendicular to the sheet transport direction, to sort the sheet per set. The stapling tray sheet detector 310 may detect existence of sheet in the stapling tray F. The release belt HP sensor 311 may detect a home position of the pair of release claws 52*a*.

Alternatively, the saddle stitchers S2 may saddle stitch the sheets into a bundle thereof along a centerline of the sheets as a bookbinding processing after alignment. The release roller 56 and other rollers may forward the saddle-stitched bundle to the folding plate 74. The folding plate 74 moves in the horizontal direction, which is perpendicular to the sheet transport direction, in FIG. 1. The folding plate 74 presses the sheets around the stitched line toward the pair of folding rollers 81, to fold the sheets. The pair of folding rollers 81 sandwiches the folded sheets therebetween and forwards the sheets to the lower tray 203, while pressurizing the sheets.

Next, a mechanism to eject sheets is further described. The pair of release claws 52*a* may turn the release belt HP sensor 311 on and off. The pair of release claws 52*a* forwards the bundled sheets from the stapling tray F alternately. The release claws 52*a* may further reverse the release belt 52 as required so that a leading edge of the sheets in the stapling tray F is aligned by the release claw 52*a* waiting to forward the sheet and by a back surface of the other release claw 52*a*.

As described above, the finisher PD may perform punching with the puncher 100, aligning with jogger fences 53, side stapling with the side stapler S1, saddle stitching with the saddle stitchers S2, sorting with the shift tray 202, and folding with the folding plate 74 and the folding rollers 81.

Figure 2:
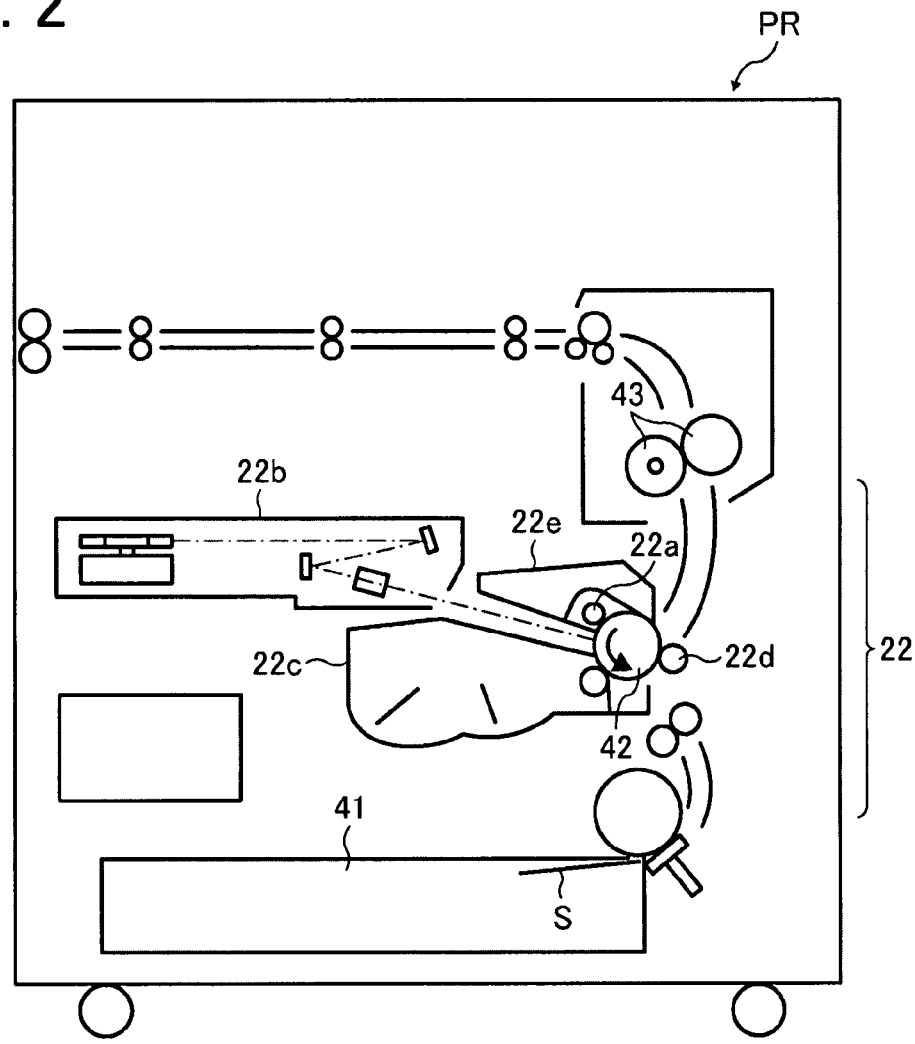
FIG. 2 is a schematic illustration (according to an example embodiment of the present invention) of an image forming apparatus included in the image forming system of FIG. 1.

FIG. 2 illustrates the image forming apparatus PR to be used in combination with the finisher PD. The image forming apparatus PR may be a copier, a facsimile, a printer, or a composite machine including the above functions. The image forming apparatus PR may include an image forming mechanism 22, a sheet feeder 41, and a fixer 43. The image forming mechanism 22 includes a photoreceptor 42, a charger 22*a*, an exposure unit 22*b*, a developing unit 22*c*, a transferer 22*d*, and a cleaner 22*e*.

A transfer material S is sent out from the sheet feeder 41 to the image forming mechanism 22. The charger 22*a* may uniformly charge a surface of the photoreceptor 42 that may rotate counterclockwise in FIG. 2. The exposure unit 22*b* may apply a laser light to the photoreceptor 42, based on image information, to form an electrostatic latent image. The developing unit 22*c* may develop the electrostatic latent image into a visible image. The transferer 22*d* may transfer the image from the photoreceptor 42 onto the sheet. After the transferring, the cleaner 22*e* may remove the toner remaining on the photoreceptor 42. The fixer 43 may fix the image on the sheet with heat and pressure. The sheet on which the image is recorded may be ejected from the image forming apparatus PR to the finisher PD. Further, the image forming apparatus PR may include a control panel for an operator to input the number of sets to be printed, to select an output mode, etc.

Figure 3:
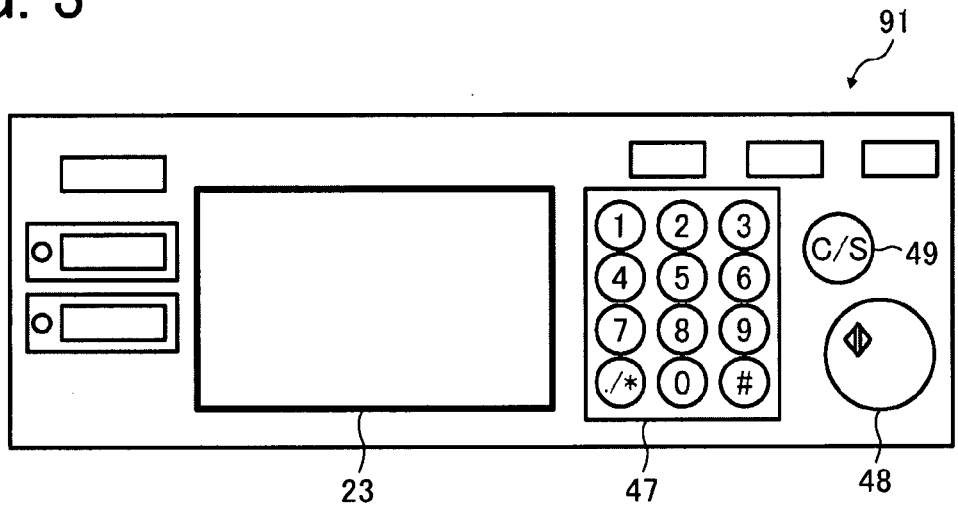
FIG. 3 is an illustration (according to an example embodiment of the present invention) of a control panel included in the image forming system of FIG. 1.

FIG. 3 illustrates a control panel 91 included in the image forming system 1. The control panel 91 may include a display 23, a numeric keypad 47, a start key 48, and a clear/stop key 49. The display 23 may indicate a state of the image forming apparatus PR and/or a message. The operator may input the number of sets using the numeric keypad 47 and may push the start key 48 to start copying, for example. If the operator inputs a wrong number or a wrong setting, or hopes to stop copying, the operator may push the clear/stop key 49.

Figure 4:
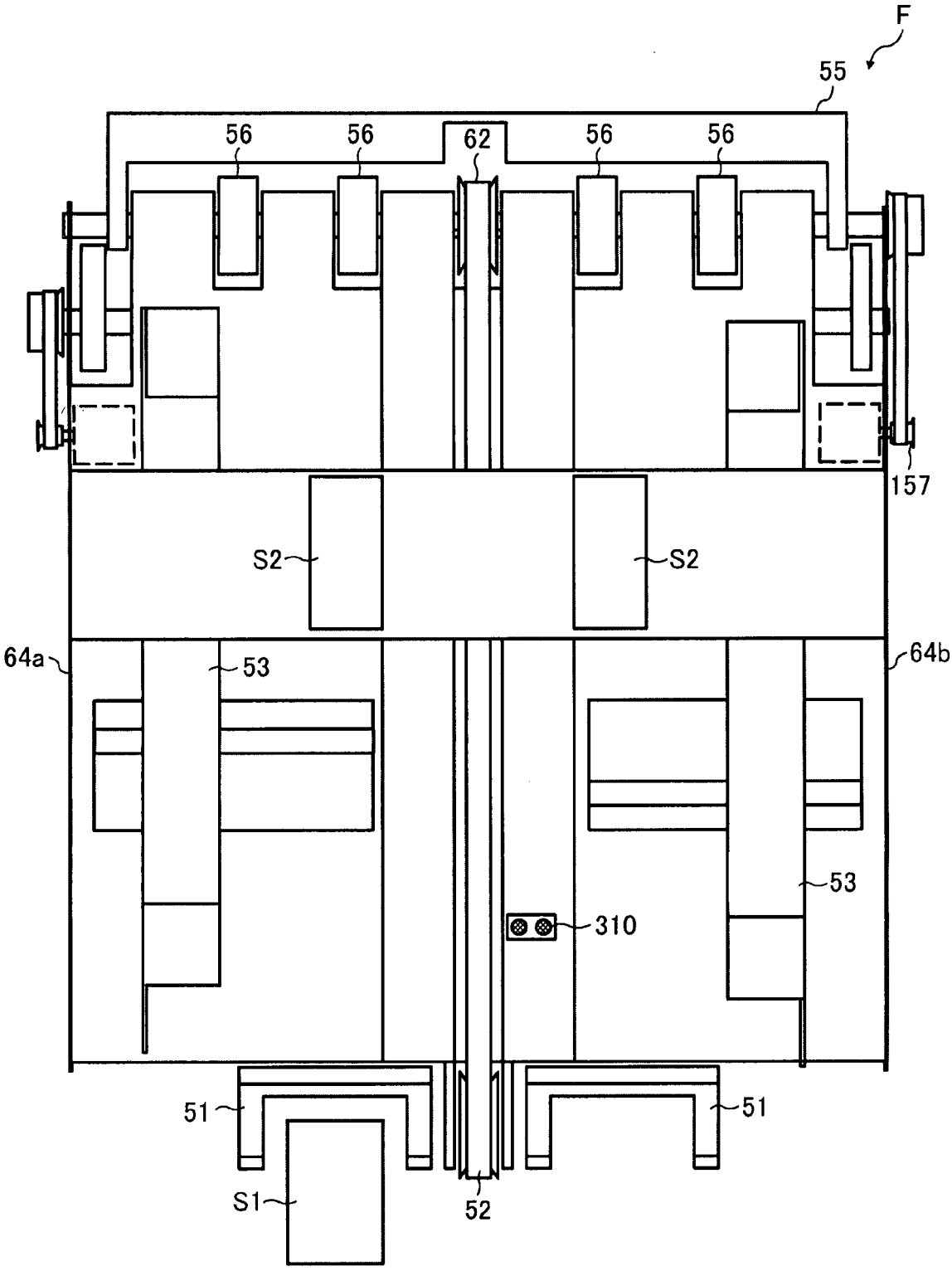
FIG. 4 is an illustration (according to an example embodiment of the present invention) of a stapling tray included in the image forming system of FIG. 1, viewed from a direction perpendicular to a sheet transport surface.

As illustrated in FIG. 4, the stapling tray F may further include a front plate 64*a*, a back plate 64*b*, a pulley 62, and a release motor 157. The release motor 157 may drive a driving shaft (not shown) of the release belt 52. The release belt 52 and the pulley 62, which may drive the release belt 52, may be provided on the driving shaft, along an aligning center in a width direction of the sheet. The release rollers 56 may be fixed at symmetrical positions with respect to the pulley 62. The release rollers 56 may be configured to rotate at a peripheral velocity higher than a peripheral velocity of the release belt 52.

Figure 5:
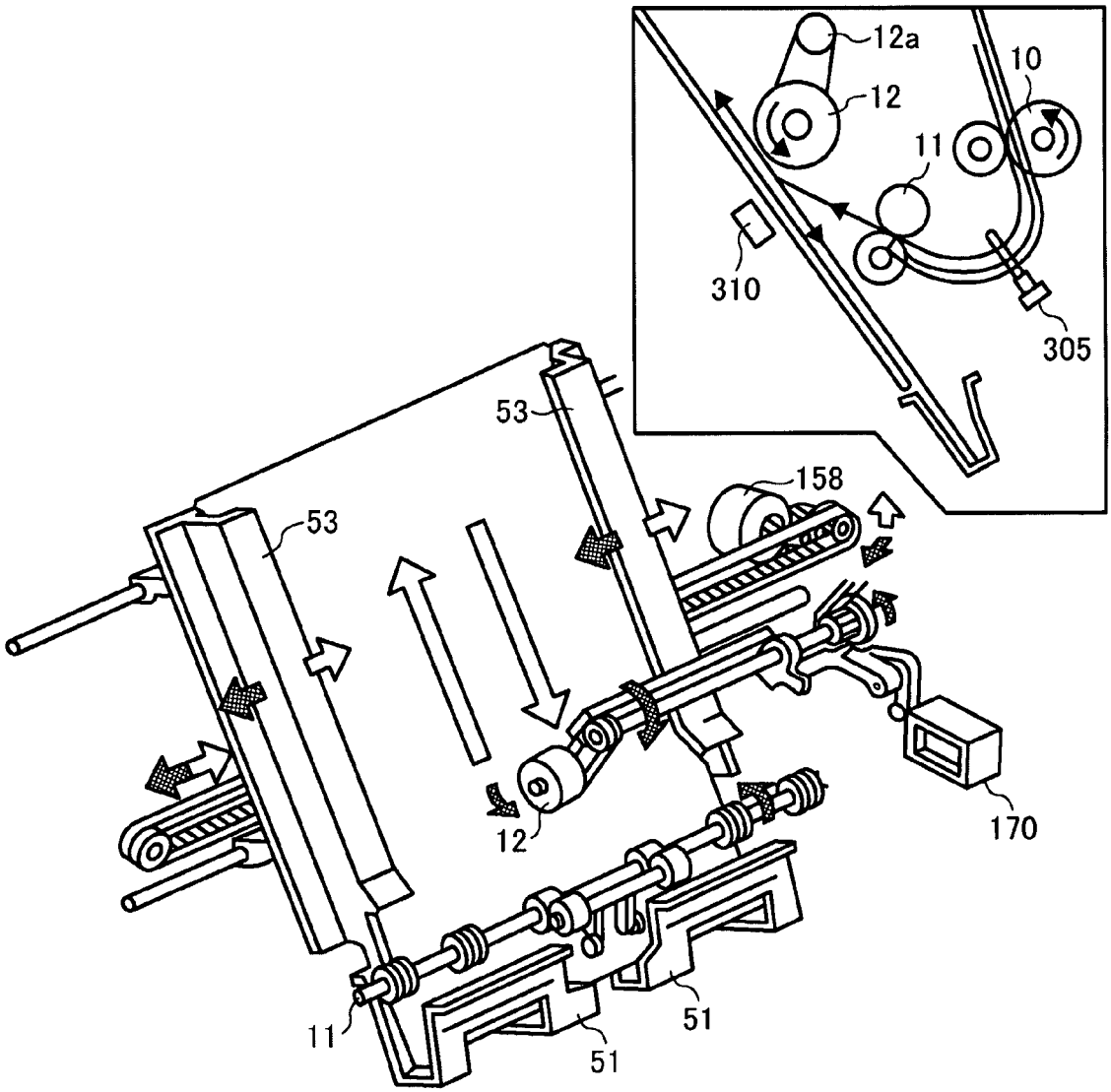
FIG. 5 illustrates (according to an example embodiment of the present invention) the stapling tray of FIG. 4 and its driving mechanism.

FIG. 5 illustrates a driving mechanism of the stapling tray F. The stapling tray F may further include a jogger motor 158 and a solenoid 170. The aligning roller 12 may be provided with a driving shaft 12*a*. The aligning roller 12 may swing around the driving shaft 12*a* (pendulum motion), caused by the solenoid 170. The jogger motor 158 may drive the pair of jogger fences 53 via a timing belt.

Figure 6:
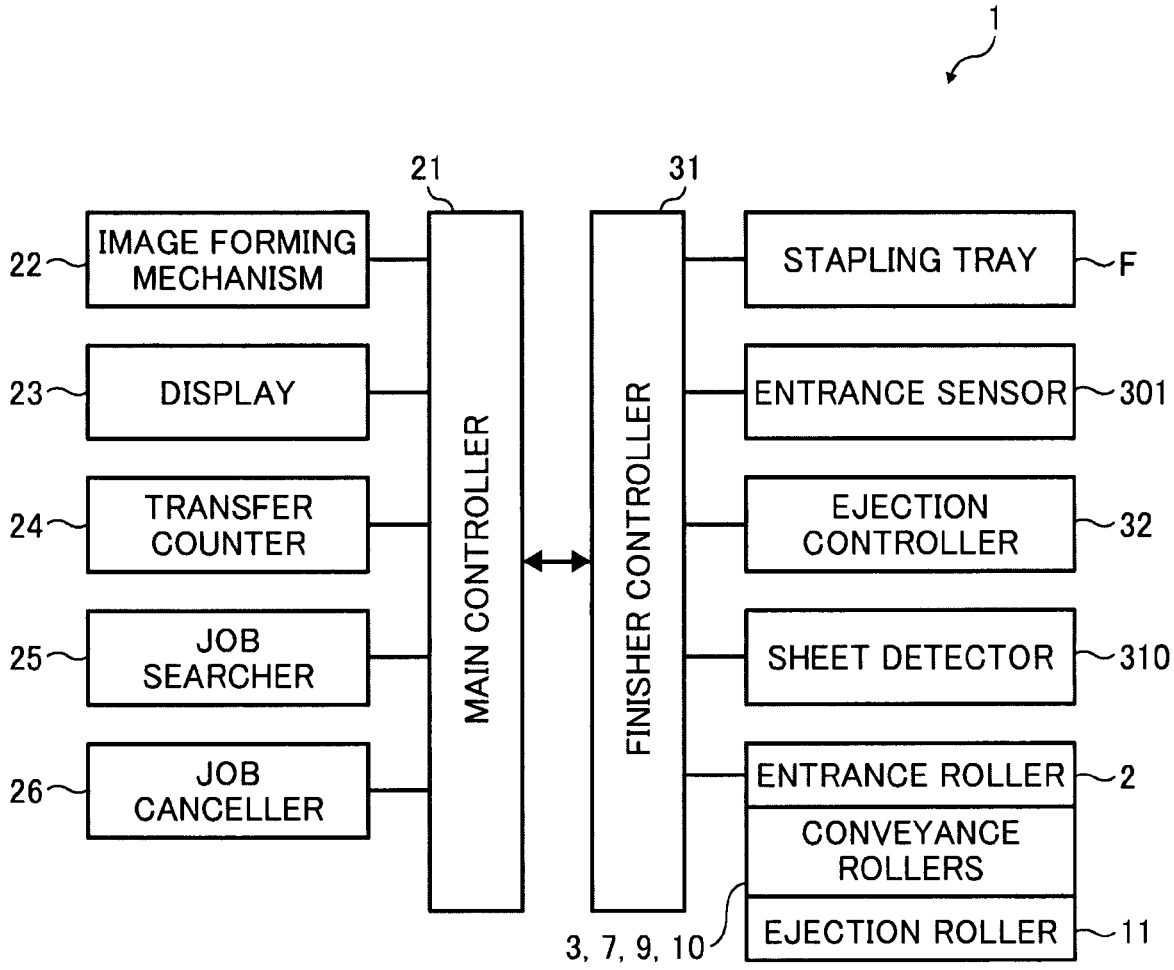
FIG. 6 is a control block diagram (according to an example embodiment of the present invention) of the image forming system of FIG. 1.

FIG. 6 is a control block diagram of the image forming system 1. As illustrated in FIG. 6, the image forming system 1 may further include a main controller 21, a transfer counter 24, a job searcher 25, and a job canceller 26 in a control system for the image forming apparatus PR. The main controller 21 connects to the image forming mechanism 22, the display 23, the transfer counter 24, the job searcher 25, and the job canceller 26.

The image forming system 1 may further include a finisher controller 31 and an ejection controller 32 in a control system for finisher PD. The finisher controller 31 may connect to the stapling tray F, the ejection controller 32, the entrance sensor 301 (counter), the shift sheet sensor 303, the stapler sheet sensor 305, the stapling tray sheet detector 310 as a sheet detector, and the transporters including the transport rollers 3, 7, 9 and 10, and the ejection roller 11. The main controller 21 and the finisher controller 31 communicate with each other.

The finisher controller 31 may send a stapling signal to drive the side stapler S1 to perform stapling as the post-processing.

The display 23 may display a message and instruction for the operator including the massage that the amount of sheets to be stitched (stapled) exceeds a capacity of finisher PD to staple. The transfer counter 24 may count how many times images are transferred onto sheets (the count representing a number of image transfer). The job searcher 25 may search waiting jobs for an executable job. The job canceller 26 may cancel a job.

The ejection controller 32 may control the ejection of sheets from the stapling tray F to the shift tray 202.

The stapling tray F may contain a plurality of sheets. The stapling tray F may staple sheets to form a bundle and eject the stapled bundle onto the shift tray 202, unless the number of sheets exceeds its capacity of stapling.

Figures 7, 7A:
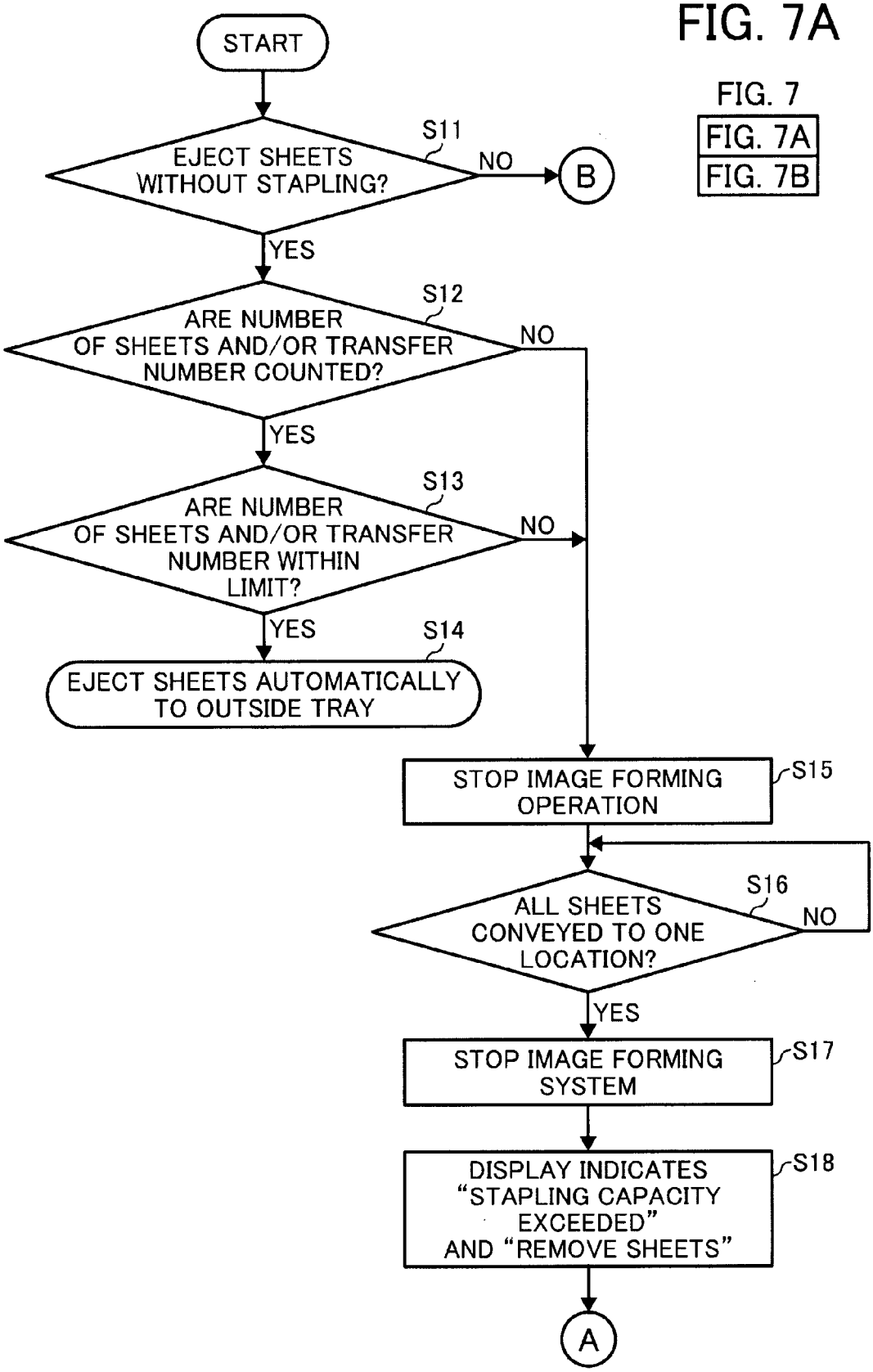
FIGS. 7A and 7B illustrate a flowchart (according to an example embodiment of the present invention) of processes performed when stapling is not performed.
Figure 7B:
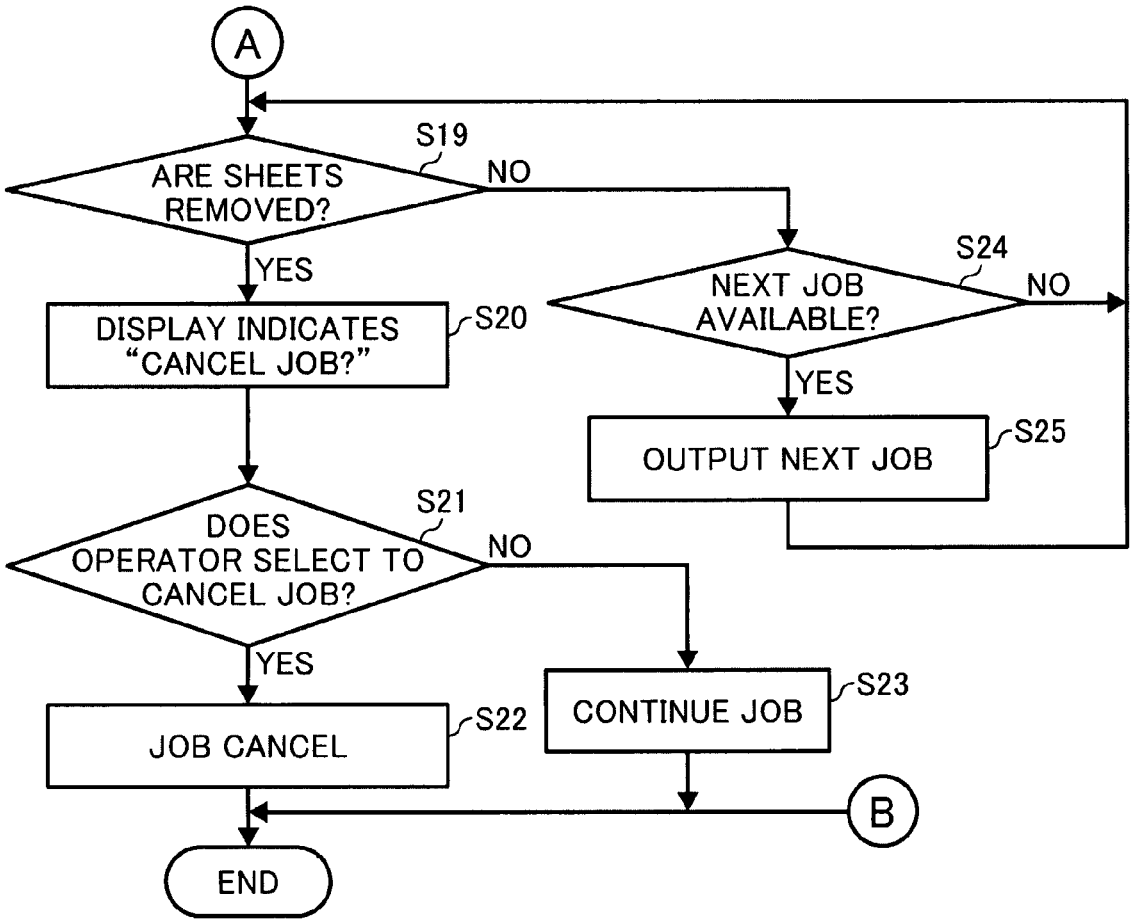

When a larger number of sheets are loaded in the stapling tray F than its capacity, processes to eject some or all of the sheets from the stapling tray F without stapling (e.g., to reduce the number of sheets in the tray to a nonzero value albeit within the stapling capacity or to zero) may be performed, e.g., as shown in FIGS. 7A and 7B.

The processes in FIGS. 7A and 7B may be performed, e.g., when the operator intends not to staple the sheets or cancels a job midway to completion, when the number of sheets stacked in the stapling tray F exceeds the capacity of the stapling tray F, or when the number of sheets is not enough to staple.

At S11, the finisher controller 31 determines whether or not it is necessary to eject the sheets to the shift tray 202 without stapling.

When the sheets are to be ejected without stapling, the finisher controller 31 may check whether or not the finisher PD includes functions to count the number of sheets transported to the stapling tray F (number of loaded sheets) and/or the number of image transfer at S12. For example, the amount of loaded sheets and the number of image transfer are examples of criteria by which to judge whether to eject some or all of the sheets automatically without stapling the ejected sheets. With the number of image transfer, an amount of one-side printed sheets and/or an amount of both-side printed sheets may be available. When the finisher PD has these functions, the finisher controller 31 may determine whether or not the amount of loaded sheets and/or the number of image transfer exceeds the reference amount or a reference number at S13.

When the finisher controller 31 determines that the amount of transported sheets and/or the number of image transfer are within the reference amount or the reference number, respectively, the sheets may be automatically ejected from the stapling tray F at S14. An operator may change the amount of sheets and/or the number of image transfer, that is, the amounts of sheets to be one-side printed and to be both-side printed, to be automatically ejected from the stapling tray F, from the control panel 91 of the image forming apparatus PR.

When a stopping condition is satisfied, the job canceller 26 may cancel the pending job. The stopping condition can include one or more of the following: the entrance sensor 301 detects that the amount of sheets exceeds the reference number, the number of image transfer exceeds the reference number, the number of loaded sheets exceeds the capacity of stapling, etc. The job canceller 26 may also cancel the pending job when the stapling tray sheet detector 310 detects that sheets in the stapling tray F are removed.

On the contrary, when the stopping condition is satisfied, or when the finisher PD does not have the function to check these numbers, the main controller 21 forbids an image forming operation at S15. Further, the image forming system 1 may check whether or not all the sheets in the image forming apparatus PR and the finisher PD are brought together in one location at S16. In an example embodiment, the sheets are brought together to the stapling tray F. When the answer is no, the image forming system 1 waits for all the sheets to be transported to the stapling tray F and then stops at S117. In this time, even if a one-side printed sheet remains in the image forming apparatus PR in the both-side mode, the image forming apparatus PR transports the sheet to the stapling tray F without forming an image on the other side of the sheet.

Figure 8:
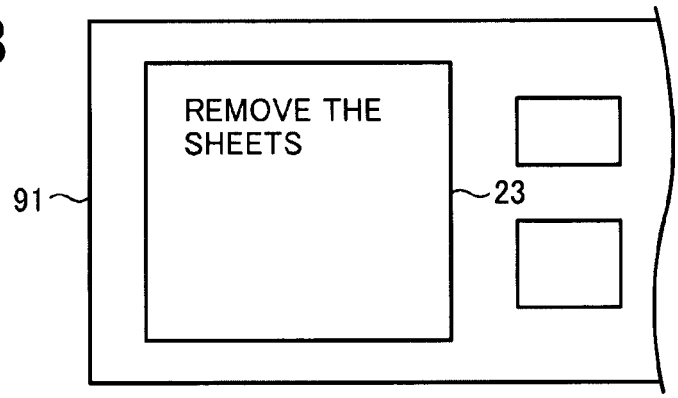
FIG. 8 is an example screen arrangement (according to an example embodiment of the present invention) of a display in the control panel of FIG. 3.

Next, the display 23 in the control panel 91 and/or a display of an computer from which the job is output may indicates that the number of sheets exceeds the capacity of stapling and may instruct the operator to remove the sheets in the stapling tray F at S18. FIG. 8 illustrates an example indication on the display 23. At S19, the finisher PD checks whether or not the sheets in the stapling tray F are removed with the stapling tray sheet detector 310.

Because it may take time to remove the sheets from the stapling tray F, the job searcher 25 searches for a next available job at S24. When the job searcher 25 finds an executable job, the main controller 21 instructs the image forming mechanism 22 to output the executable job at S25, while the operator removes the sheets from the stapling tray F.

After the sheets are removed, the display 23 may indicate a question whether to cancel the pending job at S20. For example, provided that the capacity of staple is 50 sheets and the pending job is to output three sets of 70 sheets, the image forming system stops the image forming operation when 50 sheets are loaded in the stapling tray F at S15 and the operator removes the sheets from the stapling tray F. The operator may cancel to output the remaining 20 sheets and the remaining two sets. The image forming system 1 checks whether or not the operator chooses cancellation of the job at S21. The image forming system 1 cancels the job as per the choice by the operator.

On the contrary, when the operator chooses not to cancel the job, the image forming system 1 may output the remaining pages of the job at S23.

According to an example embodiment, the image forming apparatus PR may stop forming an image when the amount of sheets loaded in the stapling tray F exceeds the reference amount. Further, all the sheets in the image forming system 1 are brought together in one location so that the operator may manually remove the sheets. Therefore, a failure in transporting sheets may be prevented because the bundle of sheets that is not stitched may not automatically sent out.

Further, the operator may cancel the remaining sets of the pending job when the number of sheets loaded in the stapling tray F exceeds the reference amount. Therefore, the operator needs not to repeat the manual removal of sheets, when a plurality of sets is set to be stapled. Therefore, the image forming system 1 may have an enhanced usability because the operator needs not to remove the bundle of sheets from the stapling tray F per set.

Further, the image forming system 1 may judge whether or not the next job is available to output while the sheets in the stapling tray F are removed. The image forming system 1 may output the next job to shorten waste time required to remove the sheets.

Further, the image forming system 1 may judge, based on the amount of sheets and/or the number of image transfer, whether to eject the sheets automatically from the stapling tray F onto the shift tray 202, when a bundle of sheets needs to be ejected without being stapled. For example, when the number of sheets is small, the sheets may be tidily stacked even if ejected automatically. The image forming system 1 may save the work of the operator by ejecting sheets automatically onto the output tray. The image forming system 1 is configured so that the operator may change the reference amount of sheets and the reference number of image transfer to automatically eject sheets. Therefore, the operator may change the setting according to a state of use.

Figure 9:
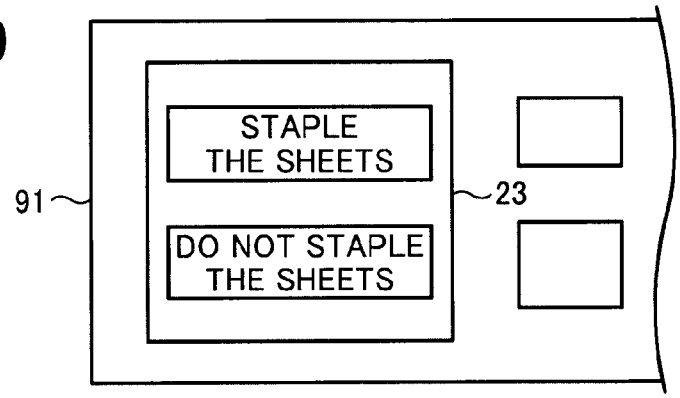
FIG. 9 is an example screen arrangement (according to an example embodiment of the present invention) of the display in the control panel of FIG. 3.

Next, variations of the flowchart of FIGS. 7A and 7B is explained. As illustrated in FIG. 9, the display 23 may indicate choices whether to perform stitching processing when the number of sheets remaining in the stapling tray F exceeds the reference number. For example, the indication of FIG. 9 appears at S18, instead of the message that number of sheets exceeds the capacity of stapling and the instruction to remove the sheets.

When the operator chooses to staple the sheets, the sheets are stapled and then automatically ejected. Simultaneously, the image forming system 1 may restart the image forming operation. On the contrary, when the operator chooses not to staple the sheets, the display 23 may indicate the instruction to manually remove the sheets.

Figure 10:
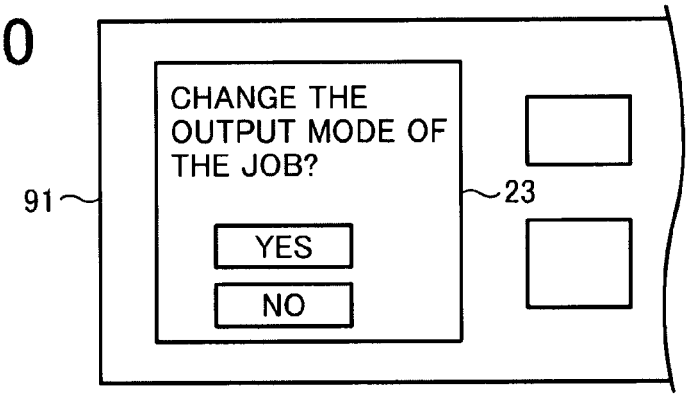
FIG. 10 is an example screen arrangement (according to an example embodiment of the present invention) of the display in the control panel of FIG. 3.

As illustrated in FIG. 10, the display 23 may indicate a question whether to change the output mode of the pending job after the stapling tray sheet detector 310 detect that the sheets in the stapling tray F are automatically or manually removed. For example, this indication may appear at S20 in FIG. 7, instead of or together with the question whether to cancel the job.

Figure 11:
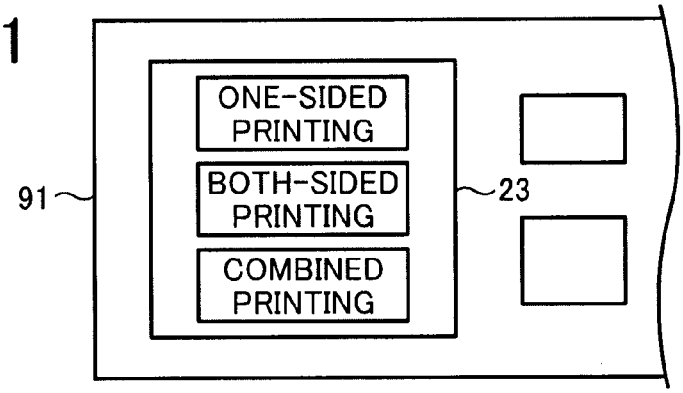
FIG. 11 is an example screen arrangement (according to an example embodiment of the present invention) of the display in the control panel of FIG. 3.

When the operator chooses to change the output mode of the job (yes), the display 23 may display choices of output modes, one-sided printing, both-sided printing, and combined printing, as illustrated in FIG. 11. The operator may reduce the number of output sheets to the capacity of stapling or the reference number of sheets to eject automatically by changing the output mode to both-side mode or combined mode.

The operator may select one of the choices and the image forming system 1 may execute the selected mode. In the combined printing mode, a plurality of pages (e.g. two pages or four pages) of an original document may be recorded on one side of a sheet. When the operator chooses not to change the output mode, the image forming system 1 may form images on sheets in the mode originally set and the operator may manually remove the sheets from the stapling tray F.

Figures 12, 12A:
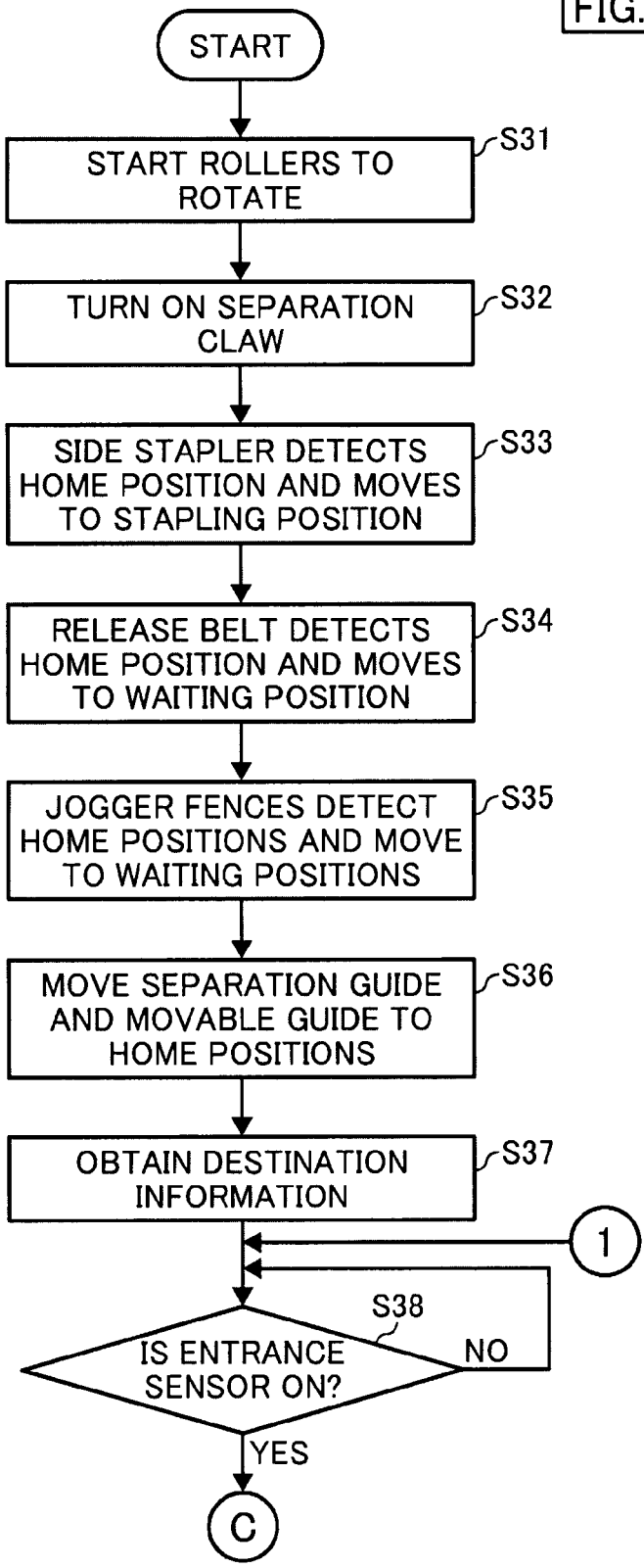
FIGS. 12A and 12B illustrates a flowchart (according to an example embodiment of the present invention) of processes to transport sheets toward the stapling tray.

FIGS. 12A to 14 illustrate a flowchart of processes to eject the sheets automatically on the shift tray 202 without stitching. As illustrated in FIG. 12A, the entrance roller 2, the transport rollers 3, 7, 9 and 10, the ejection roller 11, and the aligning roller 12 may start to rotate at S31. The solenoid may be turned on to rotate the separation claw 15 upward at S32. The side stapler S1 may detect its home position and move to a position to staple the sheets at S33. Similarly, the release belt 52 may detect its home position (release position) and move to a waiting position at S34.

The jogger fences 53 may detect its home position and move to a waiting position at S35. The separation guide 54 and the movable guide 55 may move to their home positions, which are positions to send the sheets to the shift tray 202, at S36.

At S37, the finisher controller 31 may obtain destination information from the main controller 21 to control the finisher PD based on the destination information. The destination information is information where the image forming system 1 is shipped (e.g., North America, Europe, etc.)

Figure 12B:
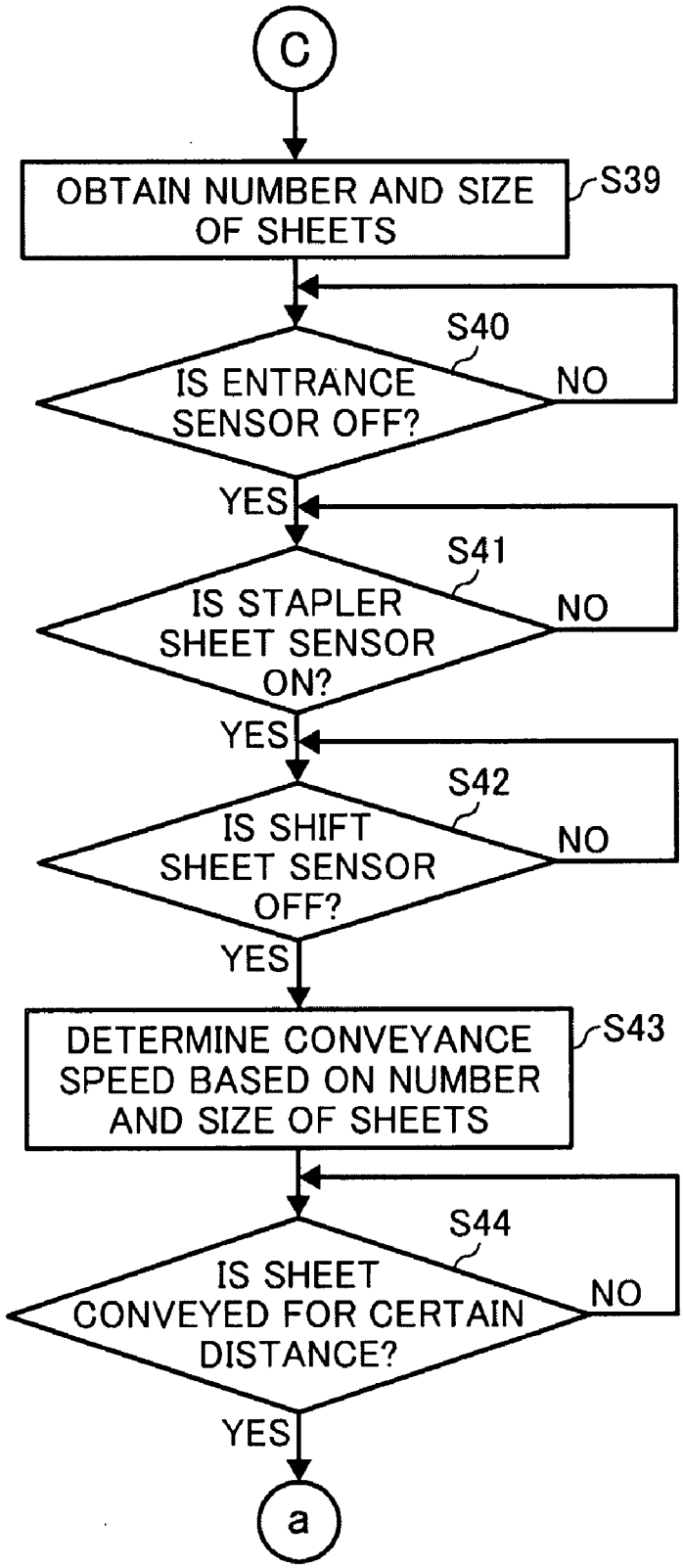

The finisher controller 31 may check whether or not the entrance sensor 301 (counter) is on at S38. When the answer is yes, the finisher controller 31 may obtain the number and the size of sheets passing the entrance sensor 301 at S39 in FIG. 12B. When the answer is no, the finisher PD may wait for a sheet to enter the finisher PD. After passing of sheets finishes, the entrance sensor 301 may be turned off. At S40, the finisher controller 31 may determine whether or not the entrance sensor 301 is off.

The stapler sheet sensor 305 may be turned on, sensing a sheet coming along the sheet transport path D. At S41, the finisher controller 31 may check whether or not the stapler sheet sensor 305 is on. When the answer is no, the finisher controller 31 may wait for the stapler sheet sensor 305 to be turned on. The finisher controller 31 may check whether or not the shift sheet sensor 303 is off at S42. If the shift sheet sensor 303 is on (no at S42) for a reference time, the finisher controller 31 may judge that there is a paper jam. When the shift sheet sensor 303 is off, the ejection controller 32 may determine a speed to transport the sheet to the stapling tray F at S43, based on the number and the size of sheets and the destination information. The finisher controller 31 may check whether or not the sheet is transported for a certain distance at S44.

Figures 13, 13A:
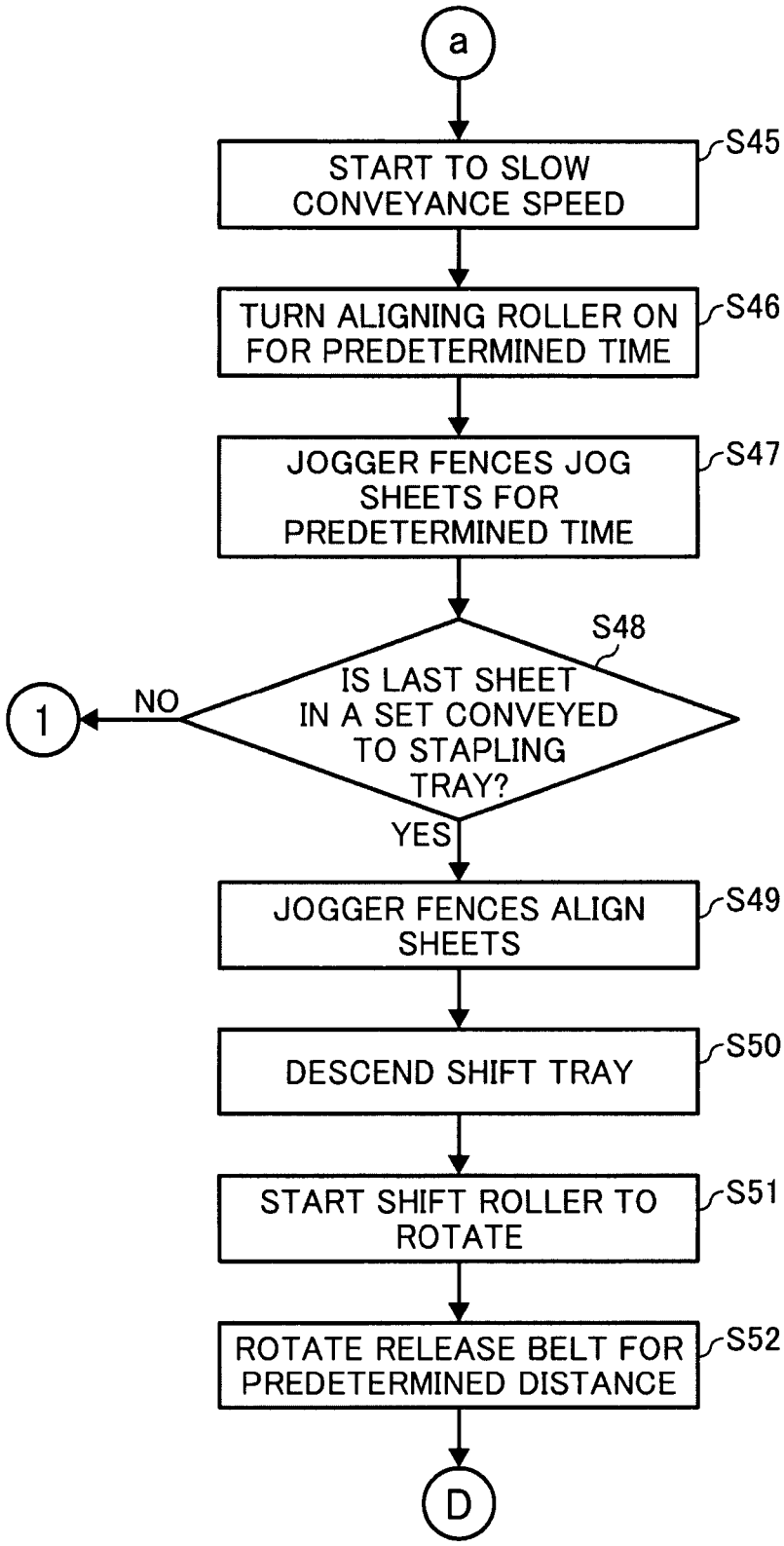
FIGS. 13A and 13B illustrates a flowchart (according to an example embodiment of the present invention) of processes to forward sheets to the stapling tray and to eject the sheets onto an shift tray.

As illustrated in FIG. 13A, when the answer is yes, the ejection controller 32 may slow the sheet transport speed at S45. The aligning roller 12 may be turned on for a reference or desirable time and swing around the driving shaft 12*a* at S46, caused by the solenoid 170. The aligning roller 12 may align the sheets by pushing the sheets to the back-end fence 51.

At S47, the jogger motor 158 may drive the pair of jogger fences 53 for a reference or desirable time, via the timing belt. The jogger fences 53 may jog the sheets in a width direction of sheets and return to the waiting position. The finisher controller 31 may check whether or not a last sheet in a set is transported in the stapling tray F at S48. When the answer is no, the finisher controller 31 may go back to S38 and repeat the processes up to S48. After the last sheet is transported to the stapling tray F, the finisher controller 31 may proceed to S49.

At S49, the jogger fences 53 may move inward for a reference distance from the waiting position to align the sheets from both sides. At S50, the shift tray 202 may descend for a reference distance. At S51, the shift ejection roller 6 may start to rotate. At S52, the release belt 52 may rotate for a reference or desirable distance to eject the set of sheets from the stapling tray F.

Figure 13B:
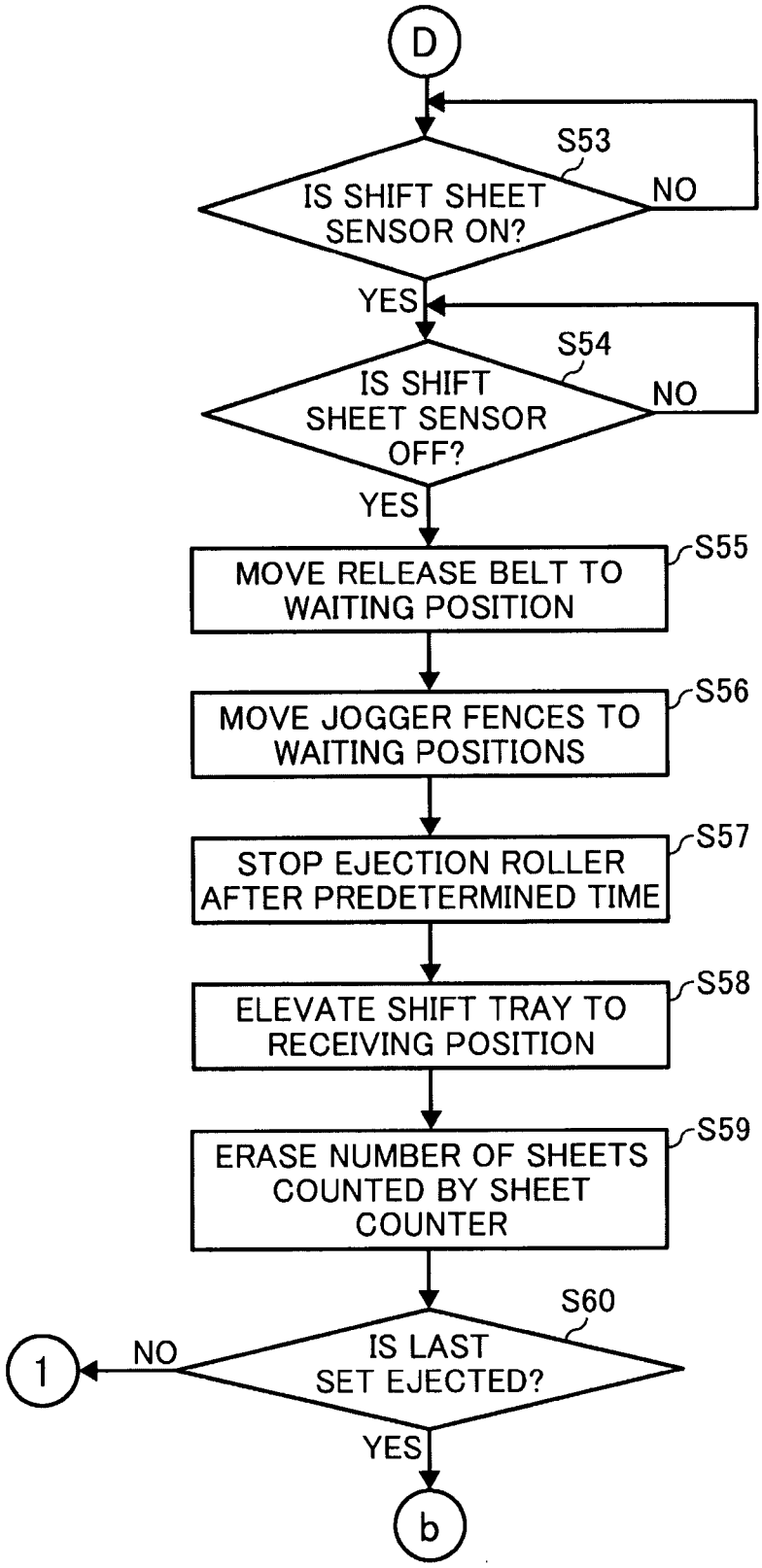

The shift sheet sensor 303 is turned on when the sheets passes the shift sheet sensor 303. The finisher controller 31 may check whether or not the shift sheet sensor 303 is on at S53 in FIG. 13B, and whether or not the shift sheet sensor 303 is turned off at S54. If the shift sheet sensor 303 is on for a reference time, the finisher controller 31 judges that there is failure such as a paper jam. When the bundle of sheets is loaded in the shift tray 202, the release belt 52 may move to the waiting position from the release positions at S55. The jogger fences 53 may return to the waiting position at S56.

After a reference time goes by after the bundle of sheets passes the shift sheet sensor 303, the ejection roller 6 may stop to rotate at S57. The shift tray 202 may go up to the receiving position and receive the sheets at S58. At S59, the number of sheets counted by the entrance sensor 301 may be erased. At S60, the finisher controller 31 may check whether or not the bundle of sheets ejected at S58 is the last set in the pending job. When the bundle of sheets is the last set, the finisher PD may return to S38 and repeat the processes up to S60.

Figure 14:
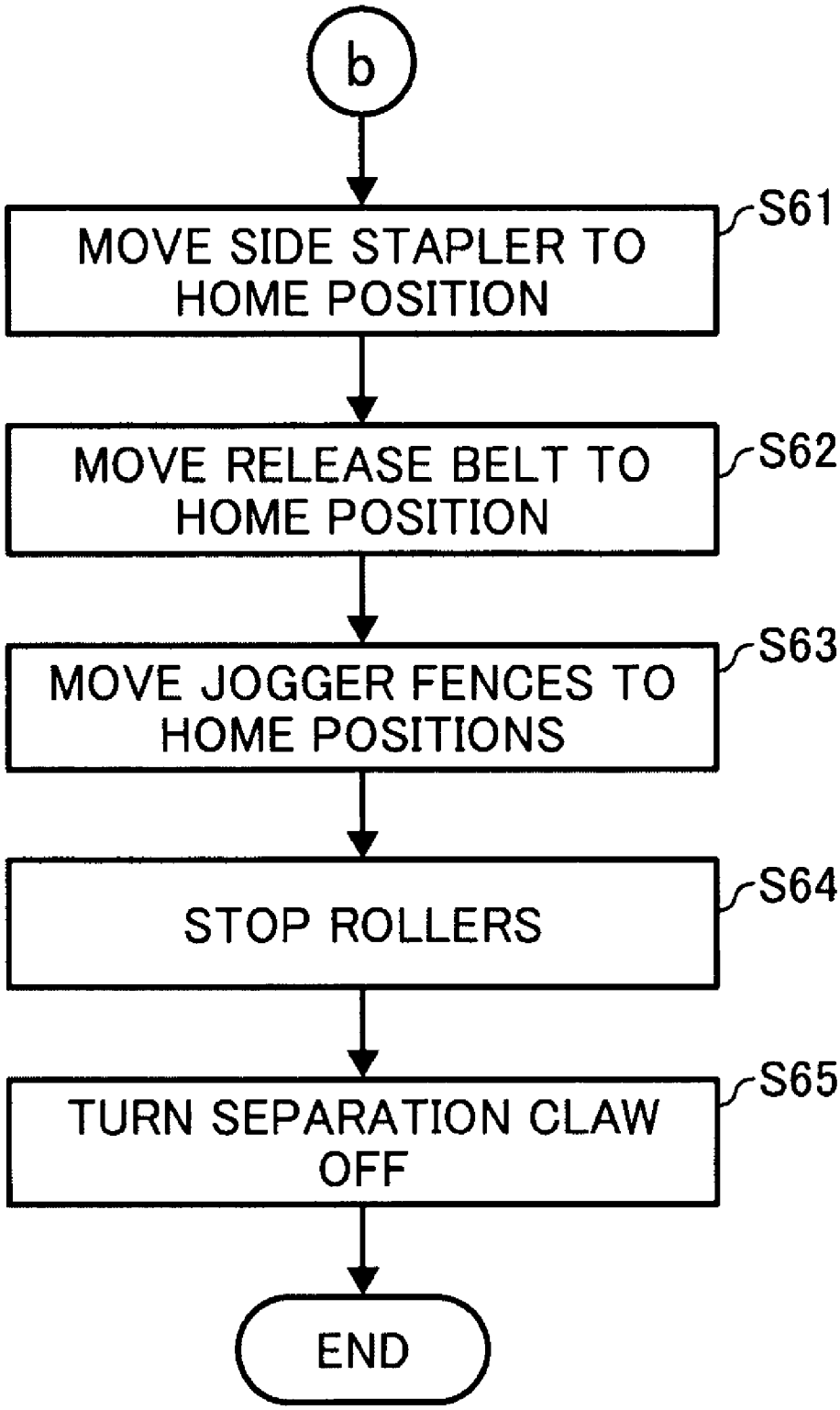
FIG. 14 illustrates a flowchart (according to an example embodiment of the present invention) of processes after the sheets are ejected onto an shift tray.

On the contrary, when the bundle of sheets is the last set, the side stapler S1 may move to the home position at S61 in FIG. 14. Further, the release belt 52 and the pair of jogger fences 53 may move to the home positions at S62 and at S63, respectively. At S64, the entrance roller 2, the transport rollers 3, 7, 9, and 10, the ejection roller 11, and the aligning roller 12 may stop to rotate. The solenoid is turned off and the separation claw 15 may rotate downward at S65 and the processes are finished.

The example embodiments may provide enhanced usability because the display 23 may indicate the instruction to remove the sheets (FIG. 8) and the question whether to staple the sheets (FIG. 9). The operator may change the output mode of the job to continue the job. The example embodiment may provide enhanced flexibility because the operator may select one of one-side printing, both-side printing, and combined printing.

Referring to FIGS. 15 to 18, an image forming system 1*a* according to an example embodiment is described. In the description below, the components having the same code as the components of the image forming system 1 illustrated in FIG. 1 to 11 have similar features and explanations thereof are omitted.

The image forming system 1*a* may check whether or not a bundle of sheets loaded in a stapling tray have a thickness exceeding a reference limit (over thickness). The image forming system 1*a* may perform similar processes to the processes performed by the image forming system 1 when detecting the over thickness.

Figure 15:
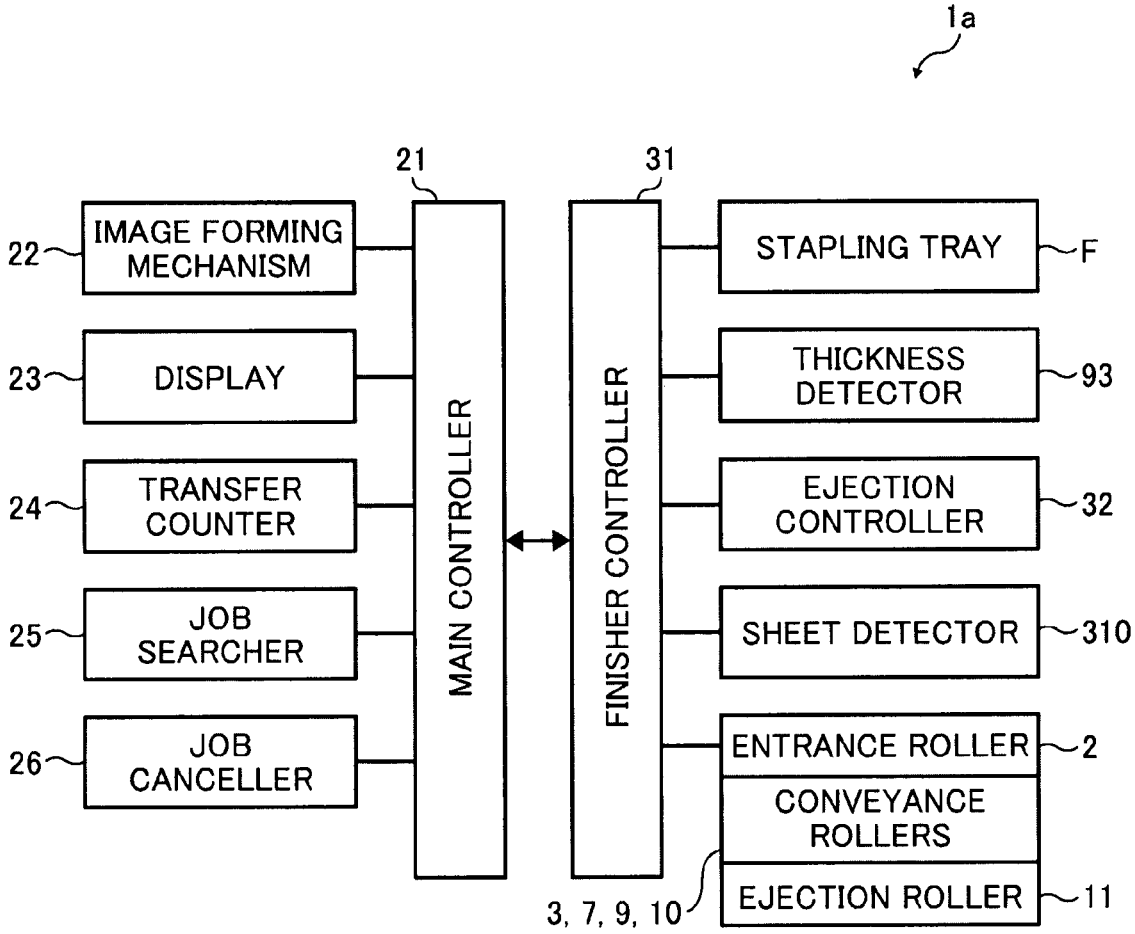
FIG. 15 is a control block diagram of an image forming system according to an example embodiment of the present invention.

FIG. 15 is a control block diagram of the image forming system 1*a*. The image forming system 1*a* may include a main controller 21 and a finisher controller 31. The main controller 21 may connect to an image forming mechanism 22, a display 23, a transfer counter 24, a job searcher 25, and a job canceller 26. The finisher controller 31 may connect to a stapling tray F, an ejection controller 32, a shift sheet sensor 303, a stapler sheet sensor 305, a stapling tray sheet detector 310 as a sheet detector, and transporters including the entrance roller 2, the transport rollers 3, 7, 9 and 10, and the ejection roller 11.

The image forming system 1*a* may further include a thickness detector 93 connected to the finisher controller 31, instead of the entrance sensor 301. The thickness detector 93 may detect the over thickness of the sheets loaded in the stapling tray F.

Figure 16:
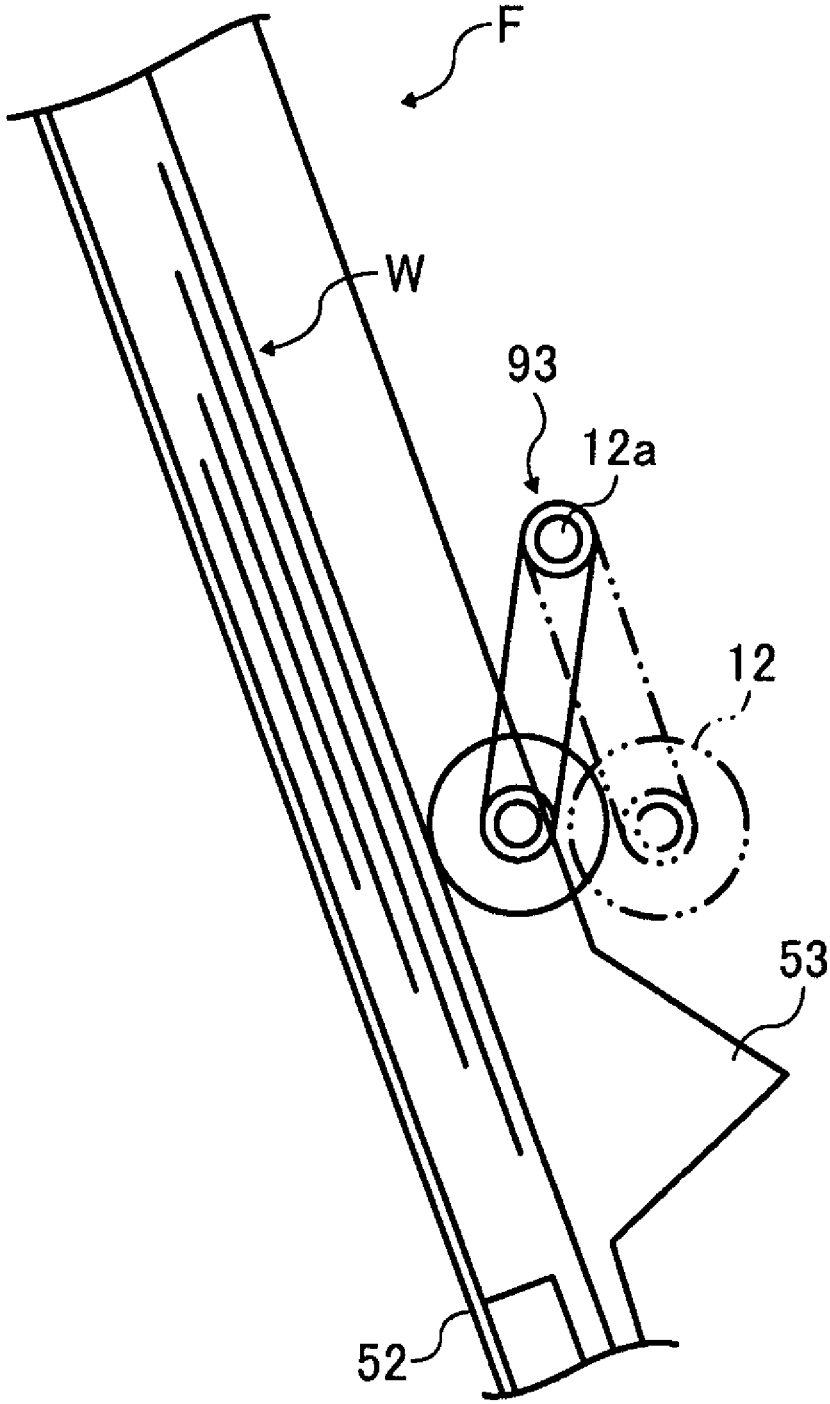
FIG. 16 illustrates an aligning roller (according to an example embodiment of the present invention) included in the image forming system of FIG. 15 and a configuration around the aligning roller.

As illustrated in FIG. 16, the thickness detector 93 may be provided on a driving shaft 12*a* of an aligning roller 12 and may rotate in synchronization with the driving shaft 12*a*.

Figure 17A:
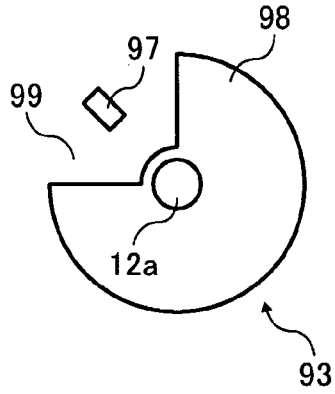
FIGS. 17A, 17B, and 17C illustrate positional relations (according to an example embodiment of the present invention) between a photosensor and a shield in an thickness detector included in the image forming system of FIG. 15.

FIG. 17A illustrate a state of the thickness detector 93 when the aligning roller 12 is at an initial position. The thickness detector 93 may include a photosensor 97, and a shielding 98. The shielding 98 may be fixed on the driving shaft 12*a* and include a cutout 98 as a light penetration region. The shielding 98 may rotate per rotation of the aligning roller 12.

Figure 17B:
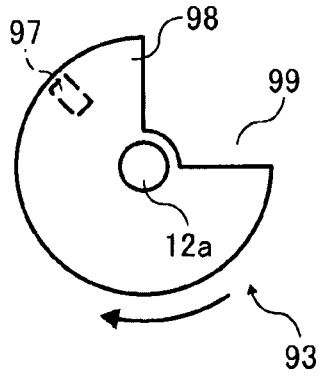
Figure 17C:
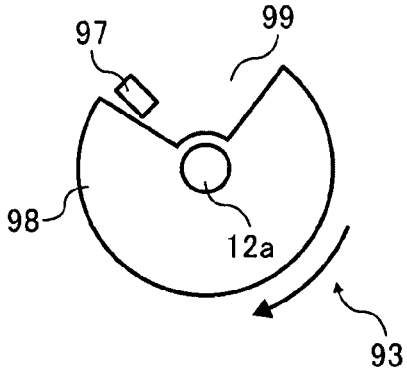

As illustrated in FIG. 17B, shielding 98 may rotate by a degree (rotation angle) large enough to obscure the photosensor 97 when the thickness of the sheets loaded in the stapling tray F is under the reference thickness. In this state, the photosensor 97 does not send an over thickness detection signal. On the contrary, the shielding 98 does not obscure the photosensor 97 as illustrated in FIG. 17C, when the thickness of the sheets loaded in the stapling tray F exceeds the reference thickness. In this state, the photosensor 97 may detect the over thickness and send an over thickness detection signal.

Figures 18, 18A:
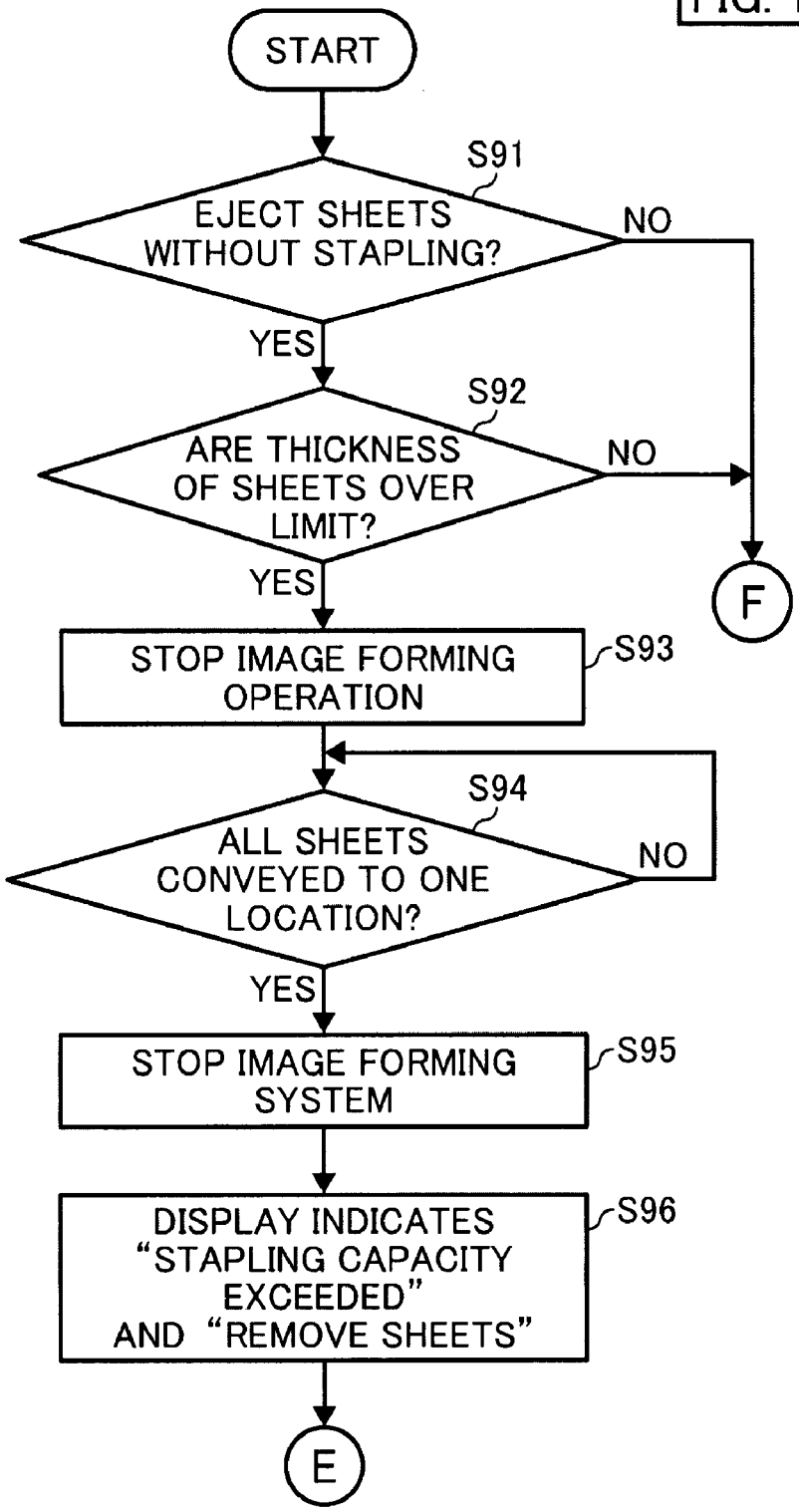
FIGS. 18A and 18B illustrate a flowchart (according to an example embodiment of the present invention) of processes performed when stapling is not performed.
Figure 18B:
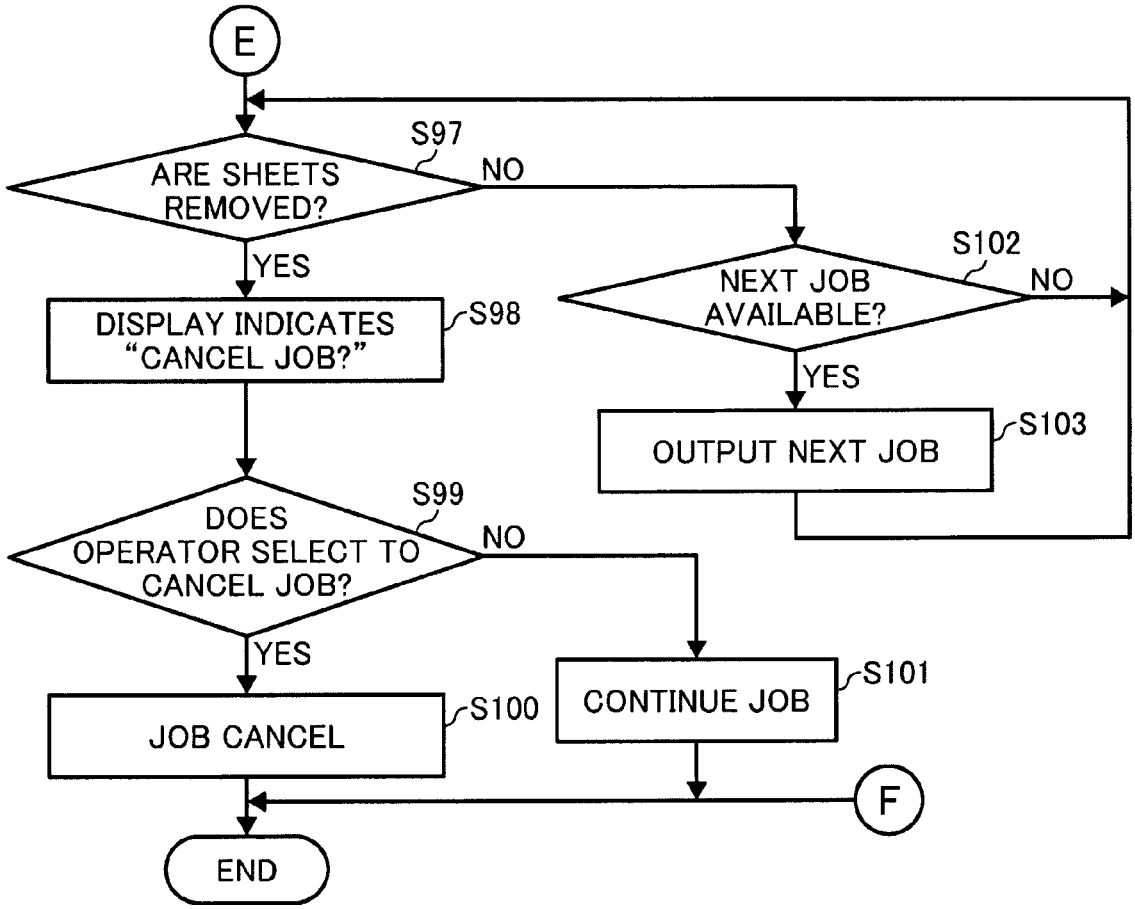

FIGS. 18A and 18B illustrate a flowchart of processes to eject sheets without stapling from the stapling tray F in the case of the over thickness. At S91, the finisher controller 31 may determine whether or not it is necessary to eject the sheets to an output tray, without stapling. When the sheets are to be ejected, the finisher controller 31 may determine whether or not the thickness detector 93 sends an over thickness detection signal at S92. When the image forming system 1*a* determines the thickness of the sheets exceed the reference thickness (yes at S92), the image forming system 1*a* may stop an image forming operation at S93.

The image forming system 1*a* may perform similar processes from S94 to S100 to the processes from S16 to S22 in FIG. 7. When it takes time to remove the sheets from the stapling tray F (no at S97), the job searcher 25 may search for a next executable job at S102. When the job searcher 25 finds an executable job, the main controller 21 may instruct the image forming mechanism 22 to output the executable job at S103. When the operator does not choose to cancel the pending job at S99, the image forming system 1 may output the remaining pages of the job at S101. The operator may change the output mode of the remaining set of the pending the job.

The image forming system may provide a similar effect to the effect of the image forming system 1. Further, the image forming system 1*a* may determine whether or not stapling is executable depending on the characteristics of sheets (e.g., thickness), even if the transfer material has a thickness thicker or thinner than a standard sheet. In that case, it is difficult to determine the thickness of the sheets stacked in the stapling tray F exceeds the capacity of stapling, based on the number of sheets.

Numerous additional modifications and variations are possible in light of the above teachings. It is therefore to be understood that within the scope of the appended claims, the disclosure of this patent specification may be practiced otherwise than as specifically described herein.

What is claimed is:

1. An image forming system comprising:

an image forming mechanism configured to form an image on a sheet of a transfer material and to transport a plurality of sheets including the sheet having the image formed thereon through a transport path provided in the image forming mechanism;

a post-processor configured to receive the plurality of sheets transported from the image forming mechanism, the post-processor including, a stapling tray provided inside the post-processor and configured to store therein the plurality of sheets transported from the image forming mechanism through a transport path provided in the post-processor, and a stapler configured to staple two or more of the plurality of sheets stored in the stapling tray;

a transporter to transport the plurality of sheets through the image forming mechanism and the post-processor along the transport paths provided in the image forming mechanism and the post processor;

a display configured to display information to an operator; and a controller configured to, determine a first stopping condition of whether the number of the plurality of sheets transported to the stapling tray exceeds a reference number, detect a second stopping condition of whether a cumulative thickness of the plurality of sheets stored in the stapling tray provided in the post-processor exceeds a reference thickness, stop further image formation by the image forming mechanism when at least one of the first and second stopping conditions is satisfied, and display an instruction via the display to request the operator to manually remove the plurality of sheets stored in the stapling tray when at least one of the first and second stopping conditions is satisfied.

2. The image forming system according to claim 1, wherein the controller is further configured to, determine whether the plurality of sheets in the image forming mechanism and the post-processor are brought to the stapling tray after stopping the image formation by the image forming mechanism, and wait for the plurality of sheets to be transported to the stapling tray before displaying the instruction via the display to request the operator to manually remove the plurality of sheets.

3. The image forming system according to claim 2, further comprising:

a sheet detector to determine whether or not the sheets stored in the stapling tray provided in the post-processor have been manually removed by the operator; and a job canceller to cancel a job, wherein the job canceller cancels a pending job one of if the sheet detector detects that the sheets stored in the stapling tray provided in the post-processor have been removed and at least one of the stopping conditions is satisfied.

4. The image forming system according to claim 3, further comprising:

a job searcher configured to search for an executable job other than the pending job that has been canceled or to be canceled while waiting for the sheet detector to determine whether or not the sheets have been manually removed by the operator, wherein when the job searcher finds the executable job, the controller is configured to cause the image forming mechanism to perform the executable job while waiting for the operator to manually remove the sheets.

5. The image forming system according to claim 2, further comprising:

a sheet detector to determine whether or not the sheets stored in the stapling tray provided in the post-processor have been removed, wherein the image forming system displays whether to change an output mode of a pending job to perform an image forming operation on the display when the sheet detector detects that the sheets stored in the stapling tray provided in the post-processor have been removed, and the image forming system waits for a choice by the operator.

6. The image forming system according to claim 2, wherein the reference number and the reference thickness of sheets are changeable.

7. The image forming system according to claim 2, further comprising:

a transfer counter configured to obtain a number of image transfer indicating a number of times the images are transferred onto the sheets, wherein the transfer counter is provided in the image forming mechanism, and the controller is configured to determine a third stopping condition of whether the number of image transfer obtained by the transfer counter exceeds a reference number, and the controller is configured to stop the further image formation by the image forming mechanism when at least one of the first, second, and third stopping conditions is satisfied.

8. The image forming system according to claim 2, wherein the image forming mechanism includes one of a copier, a facsimile machine, a printer, or a combination thereof.

9. The image forming system according to claim 2, wherein the image forming mechanism includes a photoreceptor, a charger, an exposure unit, and a developing unit.

10. The image forming system according to claim 2, wherein the controller is further configured to, display an instruction via the display to request the operator to select whether to staple the plurality of sheets stored in the stapling tray before displaying the instruction via the display to request the operator to manually remove the plurality of sheets stored in the stapling tray when at least one of the first and second stopping condition is satisfied, and cause the stapler of the post-processor to staple the plurality of sheets stored in the stapling tray when the user selects to staple the plurality of sheets, wherein the stapled sheets are automatically ejected out of the post-processor.

11. The image forming system according to claim 2, wherein if the second stopping condition is not obtainable, the controller is further configured to determine whether the post-processor is provided with functions to count the number of the plurality of sheets transported to the stapling tray to obtain the first stopping condition, and the controller stops the further image formation by the image forming mechanism if it is determined that the post-processor is not provided with the functions to count the number of the plurality of sheets such that the first stop condition is not obtainable.

12. A method for operating an image forming apparatus and a post-processor, the method comprising:

forming an image on a sheet of a transfer material using the image forming apparatus;

transporting a plurality of sheets including the sheet having the image formed thereon from the image forming apparatus to a stapling tray provided inside the post-processor through a transport path provided in the image forming apparatus and a transport path provided in the post-processor;

storing the plurality of sheets transported to the stapling tray provided in the post-processor, the plurality of sheets stored in the stapling tray being subjected to stapling;

at least one of the following, counting the number of the plurality of sheets to be loaded in the stapling tray provided in the post-processor, and detecting whether the number of the plurality of sheets exceeds a reference number to obtain a first stopping condition, and detecting a cumulative thickness of the plurality of sheets stored in the sheet tray provided in the post-processor exceeds a reference thickness to obtain a second stopping condition;

stopping further image formation by the image forming apparatus when at least one of the first and second stopping conditions is satisfied; and displaying an instruction via a display to request an operator to manually remove the plurality of sheets stored in the stapling tray when at least one of the first and second stopping conditions is satisfied.

13. The method according to claim 12, further comprising:

determining whether the plurality of sheets in the image forming apparatus and the post-processor are brought to the stapling tray after stopping the image formation by the image forming apparatus; and waiting for the plurality of sheets to be transported to the stapling tray before displaying the instruction via the display to request the operator to manually remove the plurality of sheets.

14. The method of claim 13, further comprising:

displaying an instruction via the display to request the operator to select whether to staple the plurality of sheets stored in the stapling tray before displaying the instruction via the display to request the operator to manually remove the plurality of sheets stored in the stapling tray when at least one of the first and second stopping condition is satisfied; and stapling, by the post-processor, the plurality of sheets stored in the stapling tray when the user selects to staple the plurality of sheets; and ejecting, automatically by the post-processor, the stapled sheets out of the post-processor.

15. The method according to claim 14, further comprising:

determining whether or not the sheets stored in the stapling tray provided in the post-processor have been manually removed by the operator;

canceling a pending job if one of the step of determining determines that the sheets stored in the stapling tray provided in the post-processor have been removed and at least one of the first and second stopping condition is satisfied;

searching for an executable job other than the pending job that has been canceled or to be canceled while waiting for the step of determining to determine whether the plurality of sheets have been manually removed by the operator; and causing the image forming apparatus to perform the executable job when the step of searching finds the executable job while waiting for the operator to manually remove the sheets.

16. A post processing apparatus, comprising:

a transporter configured to transport a plurality of sheets received from an image forming apparatus through a transport path provided in the image forming apparatus and a transport path provided in the post processing apparatus;

a stapling tray configured to store therein the plurality of sheets transported from the image forming apparatus through the transport paths provided in the image forming apparatus and the post processing apparatus;

a stapler configured to staple two or more of the plurality of sheets stored in the stapling tray; and a controller configured to communicate with a controller of the image forming apparatus, wherein when the plurality of sheets is transported from the image forming apparatus, the controller is further configured to, determine a first stopping condition of whether the number of the plurality of sheets transported from the image forming apparatus exceeds a reference number, detect a second stopping condition of whether a cumulative thickness of the plurality of sheets stored in the stapling tray exceeds a reference thickness, stop further image formation by the image forming apparatus when at least one of the first and second stopping conditions is satisfied, and display an instruction via a display to request an operator to manually remove the plurality of sheets stored in the stapling tray when at least one of the first and second stopping conditions is satisfied.

17. The apparatus according to claim 16, wherein the controller is further configured to, determine whether the plurality of sheets in the image forming apparatus and the post processing apparatus are brought to the stapling tray after stopping the image formation by the image forming apparatus, and wait for the plurality of sheets to be transported to the stapling tray before displaying the instruction via the display to request the operator to manually remove the plurality of sheets.

18. The apparatus according to claim 17, wherein the controller is further configured to, display an instruction via the display to request the operator to select whether to staple the plurality of sheets stored in the stapling tray before displaying the instruction via the display to request the operator to manually remove the plurality of sheets stored in the stapling tray when at least one of the first and second stopping condition is satisfied, and cause the stapler to staple the plurality of sheets stored in the stapling tray when the user selects to staple the plurality of sheets, wherein the stapled sheets are automatically ejected out of the post processing apparatus.

19. The apparatus according to claim 18, further comprising:

a sheet detector configured to determine whether or not the sheets stored in the stapling tray have been manually removed by the operator;

a job canceller configured to cancel a pending job if one of the sheet detector detects that the sheets stored in the stapling tray have been removed and at least one of the first and second stopping conditions is satisfied; and a job searcher configured to search for an executable job other than the pending job that has been canceled or to be canceled while waiting for the sheet detector to determine whether the plurality of sheets have been manually removed by the operator, wherein if the job searcher finds the executable job, the controller is configured to cause the image forming apparatus to perform the executable job while waiting for the operator to manually remove the sheets.

* * * * *